US006118406A

United States Patent [19]

Josypenko

[11] Patent Number: 6,118,406

[45] Date of Patent: Sep. 12, 2000

[54] BROADBAND DIRECT FED PHASED ARRAY ANTENNA COMPRISING STACKED PATCHES

[75] Inventor: Michael J. Josypenko, Norwich, Conn.

[73] Assignee: The United States of America as represented by the Secretary of the Navy, Washington, D.C.

[21] Appl. No.: 09/226,628

[22] Filed: Dec. 21, 1998

[51] Int. Cl.[7] ..... H01Q 1/38

[52] U.S. Cl. ..... 343/700 MS; 343/830

[58] Field of Search ..... 343/700 MS, 853, 343/846, 848, 815, 817, 829, 830

[56] References Cited

U.S. PATENT DOCUMENTS 4,089,003 5/1978 Conroy ..... 343/700 MS
4,218,682 8/1980 Yu ..... 343/700 MS
4,401,988 8/1983 Kaloi ..... 343/700 MS
5,270,722 12/1993 Delestre ..... 343/700 MS
5,874,919 2/1999 Rawnick et al. ..... 343/700 MS

*Primary Examiner*—Tan Ho
*Attorney, Agent, or Firm*—Michael J. McGowan; Robert W. Gauthier; Prithvi C. Lall

[57] ABSTRACT

A broadband phased antenna is comprised of multiple patches which are directly feed. The multiple patches provide the broadband patch antenna having overlapping narrow frequency bands and comprise a ground-plane element, multiple antenna elements, multiple dielectric layers, an RF feed line, and a feed arrangement. The ground-plane element has predetermined length and width dimensions and an aperture therein at a predetermined location near its center. The multiple antenna elements have an uppermost antenna element. The multiple dielectric layers are respectively interposed between and separate the multiple antenna elements into a stacked arrangement having odd and even numbered antenna elements.

19 Claims, 10 Drawing Sheets

BROADBAND DIRECT FED PHASED ARRAY ANTENNA COMPRISING STACKED PATCHES

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION (1) Field of the Invention

The present invention relates to a phased array comprising multiple antenna elements or patches and, more particularly, to a broadband patch antenna having overlapping bands of many staggered tuned narrow bands made up of stacked patches.

(2) Description of the Prior Art

Phased array antennas are well known and are comprised of separate antennas or antenna elements, such as patches related to the present invention, which are excited directly or parasitically, at possibly different phases with respect to each other. The radiation pattern changes according to the phase of the excitation. The terms "patches" and "antenna elements" are used herein in an interchangeable manner. Similarly, the terms "indirect feed" and "parasitic feed" are used in an interchangeable manner and the elements associated with each thereof being sometimes referred to as "parasitic elements."

Antennas comprising patch elements are known in the art and some of which are described in the following patents: U.S. Pat. No. 5,003,318 to Berneking et al.; U.S. Pat. No. 5,043,738 to Shapiro et al.; U.S. Pat. No. 5,153,600 to Metzler et al.; U.S. Pat. No. 5,155,493 to Thursby et al. and U.S. Pat. No. 5,307,075 of Huynh, all of which are herein incorporated by reference. The antennas are comprised of single or multiple patches or antenna elements each typically having a square shape and each dimensioned so that the square patch resonates at a desired resonant frequency. The resonant frequencies of the patches are selected so as to cover a band of interest comprising the desired bandwidth of the antenna.

Single square patch antennas commonly possess a narrow band (5%) bandwidth. Multiple stacked patches making up an antenna array are known and one of which is a dual patch, dual band, dual fed stacked patch shown herein in FIG. 1 for an antenna 100 having an RF feed, such as a coaxial cable with an inner and outer conductor, with the inner conductor 102 connected to two patches 104 and 106. This antenna 100 of the two patches 104 and 106 has been attempted to be made to resonate at two frequencies of narrow bandwidth with both patches 104 and 106 being excited or fed in phase, that is, excited with the same phase of the applied excitation signal. Though feeding two elements of an antenna in phase exists for dipole and quadrifilar helix antennas, this configuration has been found not to work for the patch antenna.

A dual patch, dual band, top patch fed, parasitic bottom patch, stacked patch antenna is shown in FIG. 2 as antenna 108 which is also shown on p. 321, of "Handbook of Microstrip Antennas," edited by J. R. James & P. S. Hall, 1989. FIG. 2 shows the antenna 108 comprised of patches 104 and 106 with patch 104 being connected to the inner conductor 102 of the RF feed. This antenna 108 consists of the two patches 104 and 106 made to resonate at two frequencies of narrow bandwidth. Only the top patch 104 is fed; the bottom patch 106 obtains power by coupling to the top patch 104. The coupling involved for patch 106 is commonly referred to as parasitic because the element is not directly driven but, rather, is excited by energy radiated by another patch.

A dual patch, overlapping dual band, bottom patch fed, parasitic top patch, stacked patch antenna is shown in FIG. 3 as antenna 110 which is also described on p. 321 of "Handbook of Microstrip Antennas," edited by J. R. James and P. S. Hall, 1989. FIG. 3 shows the antenna 110 comprised of patches 104 and 106 with patch 106 connected to the inner conductor 102. The antenna 110 consists of the two patches 104 and 106 made to resonate at two frequencies whose individual bands overlap to form a broader band antenna. For example, bandwidths of 10–20% are possible for antenna 110. Only the bottom patch 106 is fed; the top patch 104 obtains power by coupling to the bottom patch 104.

Only antenna 110 allows broadbanding by combining the bandwidths of two individual patches or antenna elements. The band overlapping is done by direct feeding of one element at one resonant frequency and having another parasitic element resonating at a nearby frequency. In principle, additional parasitic patches can be added to make the antenna more broadband, although the practical prior art limit is three total elements. This is because the parasites can only place resonance/antiresonance loops in the impedance locus of the fed element and which may be further described with reference to FIGS. 4(A)–4(D), which illustrate the resultant impedances of a plurality of antenna elements.

FIG. 4(A) illustrates an impedance locus of one element at resonance. FIG. 4(B) illustrates an impedance locus of one direct fed element and two parasitic elements. FIG. 4(C) illustrates an impedance locus of the configuration of FIG. 4(B) with a third parasitic element added thereto. FIG. 4(D) illustrates an impedance locus of one direct fed element at antiresonance and two parasitic elements. More particularly, FIG. 4(A) illustrates a first resonant frequency $fo$ of a single element antenna and the characteristic impedance Zo of the feed line of FIGS. 1–3. FIG. 4(B) illustrates the resonance of the element of FIG. 4(A) and second and third resonant frequencies $fo_2$ and $fo_3$ introduced by adding two elements to the antenna of FIG. 4(A), as well as a circular Voltage Standing Wave Ratio (VSWR) (shown in phantom) equal to approximately two (2). The second and third resonant frequencies $fo_2$ and $fo_3$, as well as $fo_4$ of FIG. 4(C), are represented by loops in FIG. 4. FIG. 4(C) illustrates the impedance of the three element antenna of FIG. 4B with the introduction of a fourth resonant frequency $fo_4$ from a fourth introduced element. FIG. 4(D) illustrates the impedance of the same three element antenna of FIG. 4(B), but with a different relationship therebetween and without the circle of VSWR of 2.

From FIG. 4(A) it may be seen that the locus of the fed element is a resonance ($fo$) passing through the feed Zo. A parasitic resonance of higher resonant frequency ($fo_2$) can be used to place a loop slightly above Zo as seen in FIG. 4(B). As further seen in FIG. 4(B), another parasitic resonance of lower resonant frequency ($fo_3$) can be used to place a loop slightly below Zo. This allows a broadband antenna that is matched about Zo as seen in FIG. 4(B). As shown in FIG. 4(C), if another parasitic element is added to resonate at a resonant frequency higher than $fo_2$ ($fo_4$), it introduces a loop in the locus of the fed element appreciably away from Zo and does not contribute to the impedance broadbanding; that is, the loop is shown outside a VSWR=2 circle in FIG. 4(C). The same effect (not shown) can be accomplished for a parasitic element added to resonate at a resonant frequency lower than $fo_3$. From FIG. 4(C) it is seen that the practical limit of the number of antenna elements, some being parasitically fed, involved in broadband antennas with closely spaced elements is three (3).

As opposed to the locus seen in FIG. 4(A), for some patches, the impedance locus for the fed element is actually an antiresonance locus that passes through or near Zo. However, the same principle of adding loops to its locus with parasitic elements still applies, as shown in FIG. 4(D). With each addition of a parasitic element resonance loop to the antiresonance locus, frequencies increase as the locus rotates down the Smith Chart, whereas the resonance locus frequencies increase as the locus rotates up the Smith Chart. Furthermore, as with any phased array arrangement, care must be used in constructing antennas with parasitic elements because it is possible for currents to flow in the wrong direction on a parasitic element at some frequencies which can cause degradation of the desired radiation pattern generated by the phased array. It is desired that a phased antenna array be provided comprised of patches or antenna elements that is not limited to the usage of three patches, one of which is an indirectly fed parasitic element, but rather has patches of a number greater than two and all of which are directly fed.

SUMMARY OF THE INVENTION

Accordingly, it is a general purpose and object of the present invention to provide an improved broadband phased array antenna comprised of direct fed patches. It is a further object that the broadband antenna provides a desired selected bandwidth for the phased array antenna. Further, it is an object to provide patches that allow for the radiation from the phased array antenna to yield desired and accurate radiation patterns.

These objects are accomplished with the present invention by providing a broadband antenna comprising a ground-plane element, a plurality of antenna elements, a plurality of dielectric layers, an RF feed line, and a feed arrangement. The ground-plane element has predetermined length and width dimensions and an aperture therein at a predetermined location near its center. The plurality of antenna elements has an uppermost antenna element. The plurality of dielectric layers is respectively interposed between and separates the plurality of antenna elements into a stacked arrangement having odd and even numbered antenna elements. The RF feed line has an outer conductor and a center conductor and protrudes through the aperture of the ground-plane element. The RF feed line extends upward to a feed point which is about half the distance between the ground-plane element and the uppermost antenna element. The feed arrangement is such that the outer conductor serves as a first bus connected to the ground-plane element and to every even numbered antenna element and the center conductor serves as a second bus connected to every odd numbered antenna element.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawings wherein corresponding reference characters indicate corresponding parts throughout the several views of the drawings and wherein.

DESCRIPTION OF THE PREFERRED EMBODIMENTS

Figure 1:
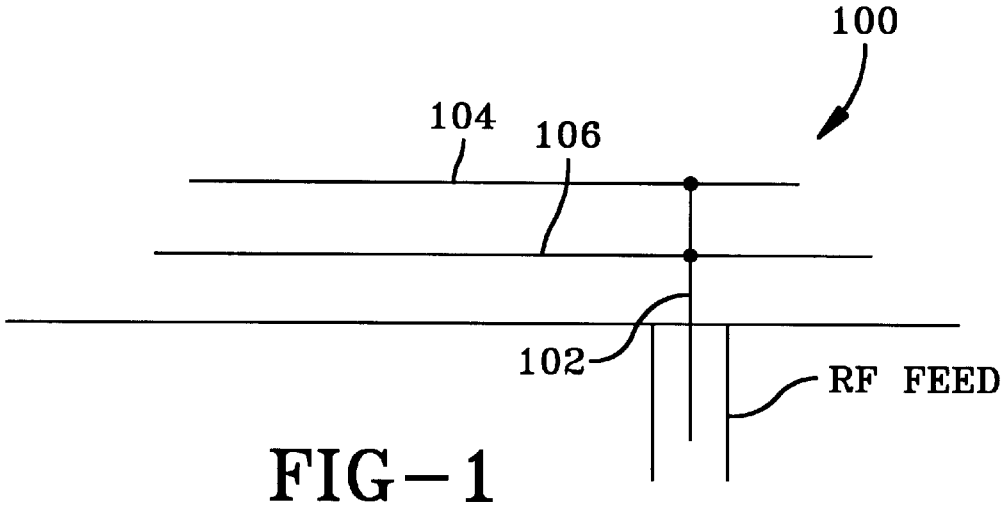
FIG-1 (PRIOR ART)
FIGS. 1, 2 and 3 illustrate prior art antennas comprised of first and second patches.
Figure 2:
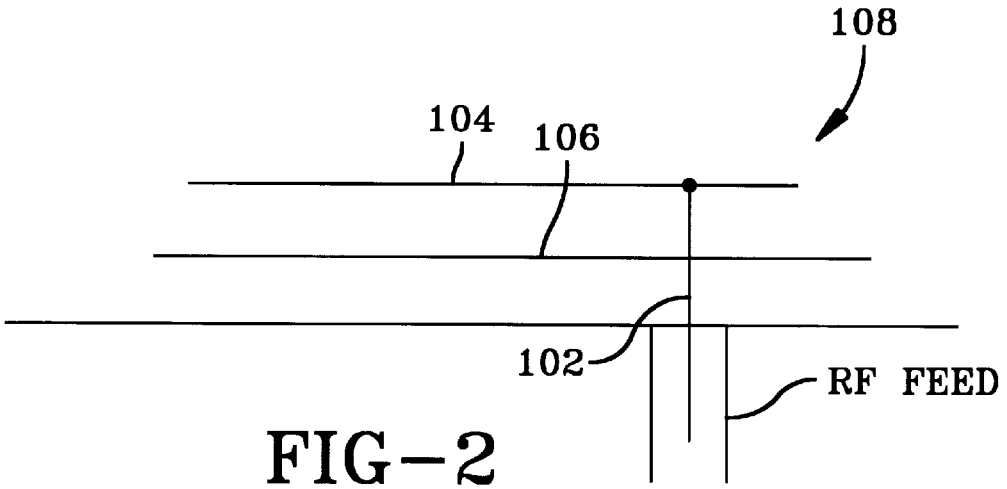
FIG-2 (PRIOR ART)
Figure 3:
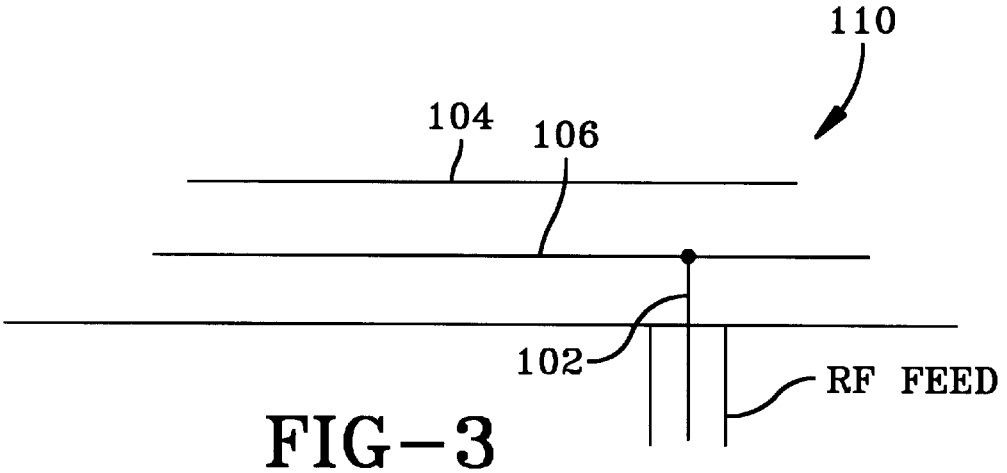
FIG-3 (PRIOR ART)
Figure 4A:
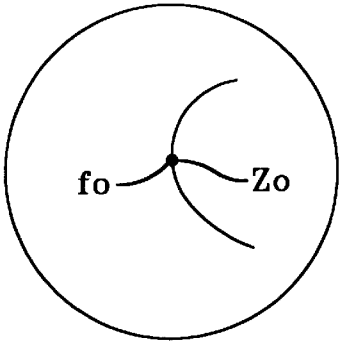
FIG-4(A) (PRIOR ART)
FIG. 4(A) illustrates an impedance locus of one element at resonance.
Figure 4B:
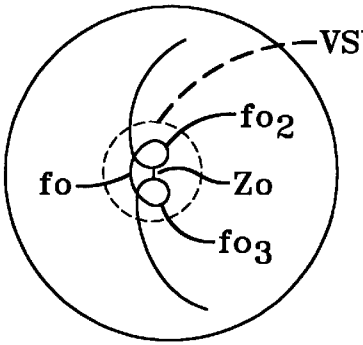
FIG-4(B) (PRIOR ART)
FIG. 4(B) illustrates an impedance locus of one direct fed element and two parasitic elements.
Figure 4C:
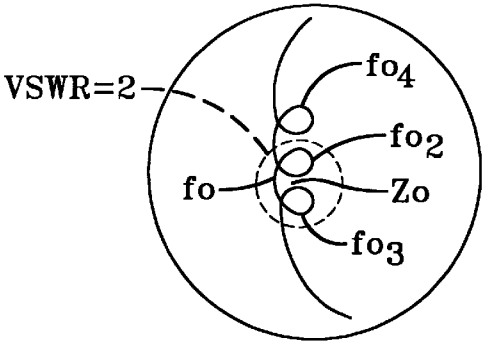
FIG-4(C) (PRIOR ART)
FIG. 4(C) illustrates an impedance locus of the configuration of FIG. 4(B) with a third parasitic element added thereto.
Figure 4D:
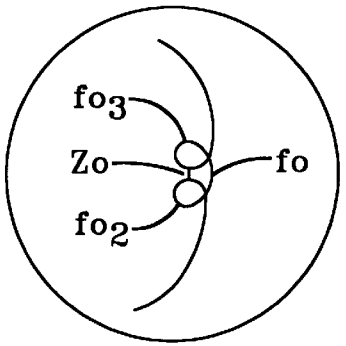
FIG-4(D) (PRIOR ART)
FIG. 4(D) illustrates an impedance locus of one direct fed element at antiresonance and two parasitic elements.
Figure 4E:
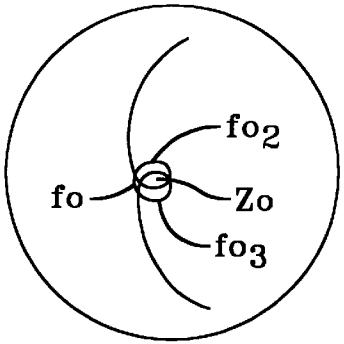
FIG. 4(E) illustrates an impedance locus of three direct fed elements associated with the present invention.
Figure 5:
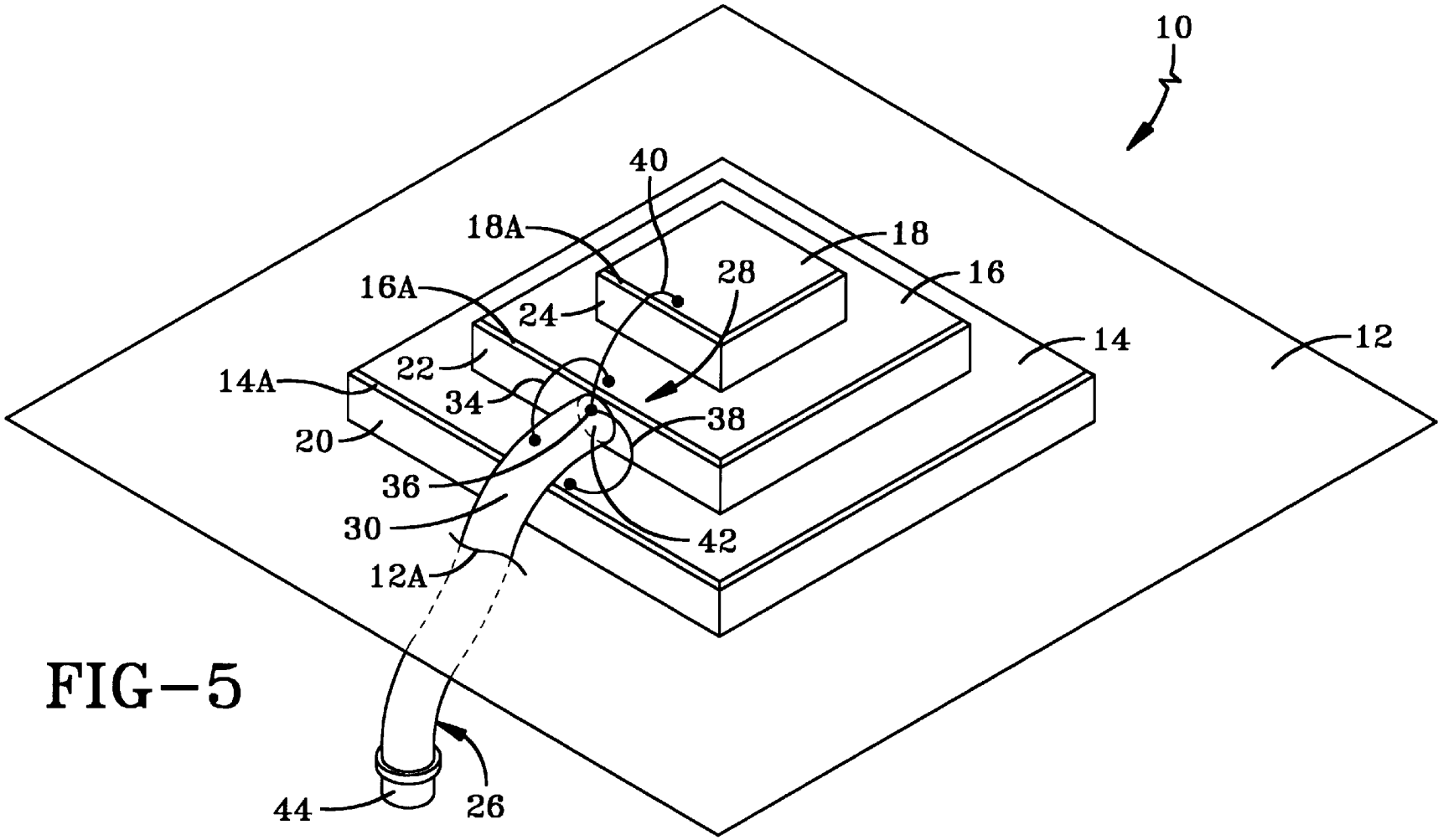
FIG. 5 illustrates an antenna configuration in accordance with one embodiment of the present invention.

With reference to the drawings, there is shown in FIG. 4(E) an impedance locus related to the stacked broadband phased antenna configuration 10 of FIG. 5 of the present invention.

In general, the present invention exemplified by the antenna configuration 10 solves the problems of having a limited number, such as three, of patches making up a broadband stacked antenna and having unwanted radiation patterns radiating from the broadband stacked antenna. This solution is provided by the direct feeding of all elements. The feed method is similar to that disclosed in U.S. Pat. 5,138,331, to the instant inventor which is herein incorporated by reference, in that all elements are directly fed, with adjacent elements being fed 180 degrees out of phase from each other. Since each element is directly fed, all the impedance loops related to impedance locus of FIG. 4(E) created by the additional elements can be ideally made to revolve a common resistance (usually designed to be the feed cable impedance, Zo), as shown in FIG. 4(E) for three directly fed elements. Thus, unlike a limit of three (3) elements in the parasitic case, such as those discussed with reference to FIGS. 4(B) and 4(C), more than three (3) elements can be used by directly feeding each element making up the stacked broadband phased antenna array. Also since with direct feeding, the phases of all elements are controlled, the possible undesired radiation patterns created by the parasitic elements are avoided. The antenna configuration 10 of FIG. 5 is a broadband antenna comprising a ground-plane element 12, a plurality of patches or antenna elements, such as antenna elements 14, 16 and 18, a plurality of dielectric foam layers 20, 22, and 24, an RF feed line 26 and a feed arrangement 28 having a first bus 30, i.e., the outer conductor of feed line 26, with connections such as 34, and a second bus 36, i.e., the inner conductor of feed line 26, with connections 38 and 40. Although three antenna elements 14, 16 and 18 and three dielectric layers 20, 22 and 24 are shown as making up the antenna configuration 10, it should be recognized that the plurality of antennas and dielectric layers is not limited to three (3).

The ground-plane element 12 has predetermined length and width dimensions and has an aperture 12A therein at a predetermined location near its center, adjacent to patch 14. The plurality of antenna elements has an uppermost antenna element 18. The plurality of dielectric layers 20, 22, 24 is respectively interposed between and separate the plurality of antenna elements 14, 16, and 18 into a stacked arrangement as shown in FIG. 5.

The RF feed line 26 protrudes through the aperture 12A of the ground-plane element 12. The RF feed line 26 extends upward from the aperture 12A to about half the distance between the ground-plane element 12 and uppermost antenna element 18. The end of the RF feed-line 26 is shown at the location of second bus 36 which is the feed point of the RF feed line 26.

The first bus 30, or outer conductor is connected to the ground-plane element 12 by appropriate connection means, such as a solder, and to the center edge of every other antenna element, beginning with the second antenna element. For the embodiment of FIG. 5, bus 30 is connected to ground-plane element 12 by soldering about aperture 12A and is connected to antenna element 16, the second element, by means of a wire 34 with appropriate connection means at the centerline of edge 16A. The second bus 36 is connected to the center edge of every other antenna element, beginning with the first antenna element nearest the ground-plane element 12. For the embodiment of FIG. 5, bus 36 is connected to first antenna element 14 and other antenna element 18 by way of wires 38 and 40, and appropriate connection means at the centerlines of edges 14A and 18A, respectively.

In one embodiment, the ground-plane element 12 is a 12" square made of 3 mil copper tape and forms the base of the antenna configuration 10. Centered on the ground-plane element 12 are three square patches or antenna elements 14, 16 and 18, each made of 3 mil copper tape and stacked on top of each other and separated from each other by three 0.25" thick spacers of foam dielectric material serving as the dielectric layers 20, 22 and 24. The location and typical sizes of the antenna elements or patches 14, 16 and 18 are given in Table 1.

TABLE 1

| PATCH | DISTANCE ABOVE GROUND PLANE 12 | SIZE |
|---|---|---|
| 14 | 0.25" | 5.906 × 5.906" |
| 16 | 0.5" | 5.5 × 5.5" |
| 18 | 0.75" | 4.9 × 4.9" |

The feed line 26 may comprise a 0.085" diameter coaxial feed cable which, as previously mentioned, protrudes through the ground-plane element 12 at aperture 12A near the centerline of edge 14A of patch 14 to approximately half the distance between the ground-plane element 12 and patch 18, in order to feed the patches 14, 16 and 18 in an unbalanced manner. Similar to the feed arrangement described in U.S. Pat. 5,138,331, the feed arrangement 28 of the present invention provides that adjacent patches (elements) are fed 180 degrees out of phase from each other (the ground-plane element 12 can be considered as a patch element). For example, as seen in FIG. 5, the antenna element 14 is directly fed from the center conductor (bus 36) (that may be considered 0 degree phase) of the feed line 26 by means of wire 38 and, conversely, the antenna element 16 adjacent to antenna element 14 is directly fed from the outer conductor (bus 30) (that may be considered 180 degree phase) of the feed line 26 by means of wire 34 and, thus, the phase between adjacent elements (14 and 16) is 180 degrees.

The 180 degrees out of phase feed allows the individual matched bands of each patch to be combined to form a broadband antenna in a manner to be further described. Short wires 38 and 40 are used to connect the center conductor (bus 36) to patches 14 and 18. The end of the feed line 26 on the backside of the ground-plane element 12 opposite antenna elements 14–18, is the external feed point 44 of the antenna, i.e., where a source or receiver of the antenna configuration 10 may be connected. The below table 2 summarizes each part of the antenna configuration 10 of FIG. 5.

TABLE 2

| REFERENCE NUMBER | DESCRIPTION |
|---|---|
| 12 | 12" SQUARE OF 3 MIL COPPER TAPE |
| 14 | 5.906 × 5.906" SQUARE OF 3 MIL COPPER TAPE |
| 16 | 5.5 × 5.5" SQUARE OF 3 MIL COPPER TAPE |
| 18 | 4.9 × 4.9" SQUARE OF 3 MIL COPPER TAPE |
| 20 | 0.25" THICK DIELECTRIC FOAM SEPARATING GROUND PLANE AND PATCH 14 |
| 22 | 0.25" THICK DIELECTRIC FOAM SEPARATING PATCH 14 AND PATCH 16 |
| 24 | 0.25" THICK DIELECTRIC FOAM SEPARATING PATCH 16 AND PATCH 18 |
| 26 | 0.085" DIAMETER COAXIAL CABLE |
| 34 | NO. 20 WIRE BETWEEN OUTER CONDUCTOR AND PATCH 16 |
| 38 | NO. 20 WIRE BETWEEN CENTER CONDUCTOR AND PATCH 14 |
| 40 | NO. 20 WIRE BETWEEN CENTER CONDUCTOR AND PATCH 18 |
| 44 | END OF COAXIAL CABLE 26 WHERE ANTENNA IS FED |

In the practice of the invention, a broadband impedance match was accomplished by adjusting the patch widths such that the patches 14, 16 and 18 had three resonances spread across the broader band of a desired phased array antenna such as the antenna configuration 10 of FIG. 5. These typical resonances are given in Table 3.

TABLE 3

| PATCH | RESONANCE |
|---|---|
| 14 | APPROXIMATELY 900 MHz |
| 16 | APPROXIMATELY 990 MHz |
| 18 | APPROXIMATELY 1080 MHz |

In general, the broadband antenna having a band of interest so as to establish a desired bandwidth is accomplished by selecting the dimensions of the antenna elements so that each resonance at a particular resonant frequency. The dimensions of the lowermost antenna element 14, i.e., the antenna element closest the ground-plane element 12, are selected so that its resonant frequency is at the bottom of the band of interest. The dimensions of the next closest antenna element to the ground-plane element 12, antenna element 16 in FIG. 5, are selected relative to the lowermost element 14 so that its resonant frequency is greater than that of the lowermost element 14, but overlaps that of the lowermost element 14 within a reasonable VSWR of less than 1.5. The dimensions of the next closest antenna element to the ground-plane element 12, that is antenna element 18 in FIG. 5, are selected so that its resonant frequency is greater than that of antenna element 16, but overlaps that of antenna element 16 and with the resultant VSWR of all three elements being less than 4:1. The width of the overall bandwidth is approximately the combined bandwidths of the individual patches. Considering the case where only two elements, 14 and 16, comprise the antenna it should be recognized that if a higher VSWR, that is, greater than 1.5, can be tolerated within the overall band, the resonant frequencies of the two patches, can be correspondingly separated more so as to correspondingly give more bandwidth to the desired phased antenna array. If the frequencies are separated too far apart, a VSWR peak starts to form between the two frequencies and the antenna 10 becomes a dual band antenna, with two bands centered about the two patch resonances of patches 14 and 16.

For the antenna configuration 10 of FIG. 5, the two resonances of patches 14 and 16 were chosen to be those shown in table 3, which gave a 1.5 VSWR bandwidth of 7.1%. A larger bandwidth with a higher VSWR was obtainable, but was not done because of requirements of the addition of patch 18. Next patch 18 was added and its resonance was chosen like that of patch 14 because its band was desired to overlap with that of patch 16. However, in order to obtain a somewhat reasonable level overall band match for a three patch stacked antenna array, it was found that the match obtained with only patches 14 and 16 had to be very good (<1.5 VSWR) to provide for the advantageous addition of the third patch 18.

Figure 6:
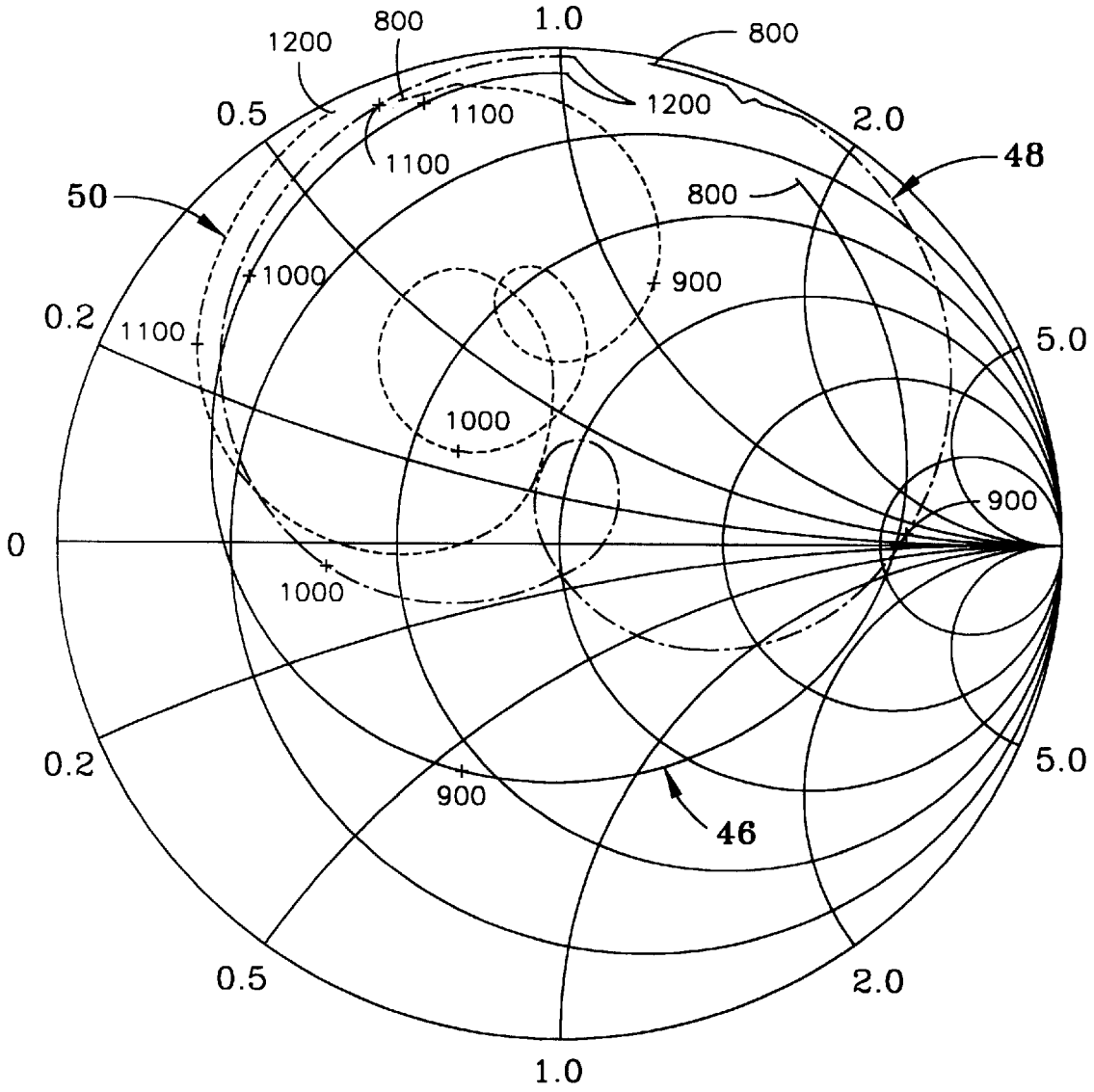
FIG. 6 is a Smith Chart impedance plot related to the antenna configuration of FIG. 5.
Figure 7:
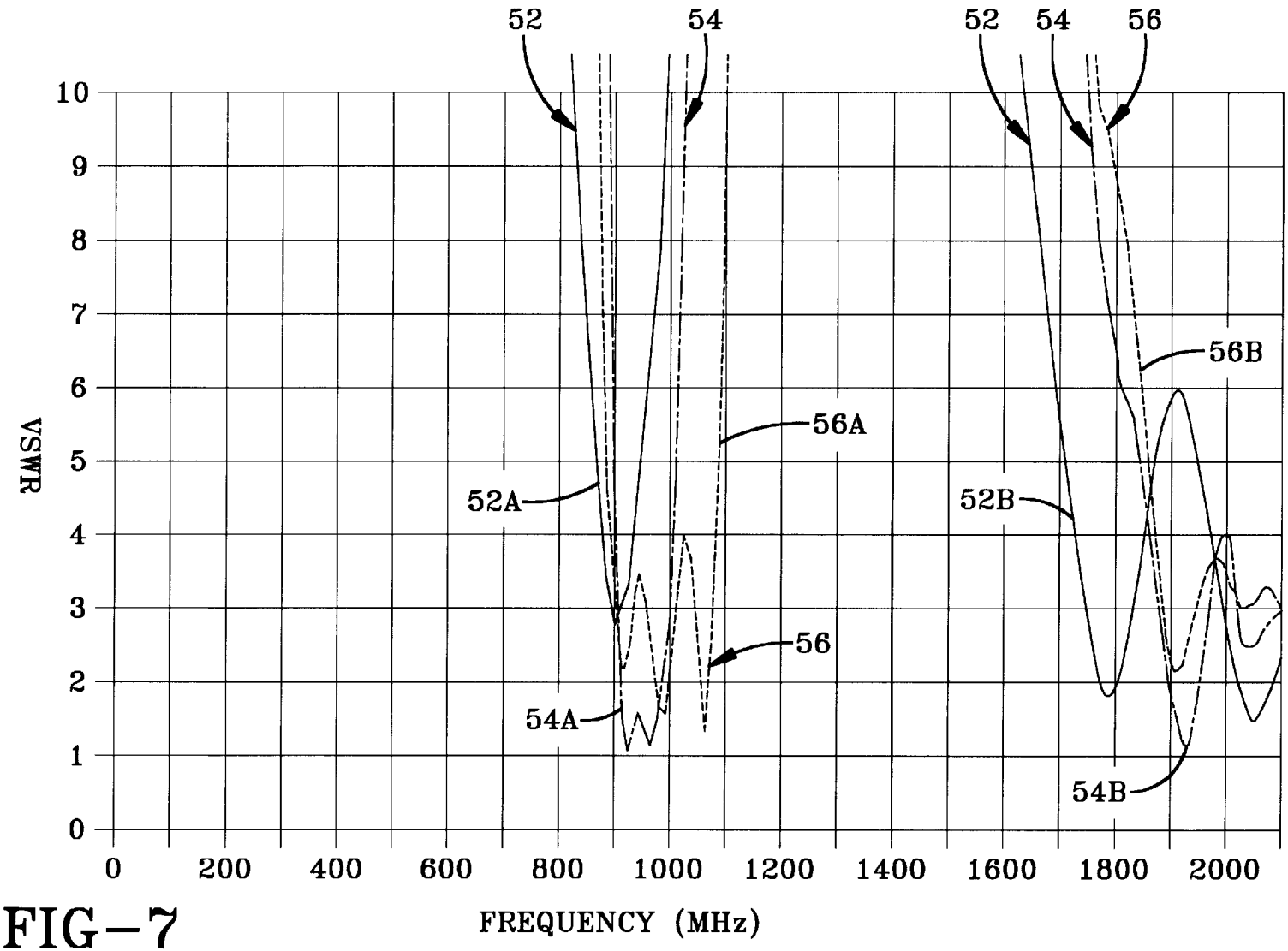
FIG. 7 illustrates the VSWR response characteristics related to the antenna configuration of FIG. 5.

The parameters related to the bandwidths that are obtainable by the practice of the present invention are shown in FIGS. 6 and 7, wherein FIG. 6 has three impedance loci 46, 48 and 50 and, similarly FIG. 7 has three VSWR curves set out as 52, 54 and 56. With reference to FIG. 6, the impedance loci 46, 48 and 50 each have an initial starting point labeled 800 (MHz) and a final end point labeled 1200 (MHz). With reference to FIG. 7, the VSWR curve 52 is composed of segments 52A and 52B, identified thereon; VSWR curve 54 is composed of segments 54A and 54B identified thereon; and VSWR curve 56 is composed of segments 56A and 56B, identified thereon. The impedance loci 46, 48 and 50 of FIG. 6 are respectively interrelated to the VSWR hands 52, 54 and 56 of FIG. 7. A tabulation between the obtainable bandwidth of FIGS. 6 and 7 are given in Table 4.

TABLE 4

| ANTENNA ELEMENTS | 4:1 VSWR BANDWIDTH | FIGURE |
|---|---|---|
| 14 | 5.7% | 6 (46), 7 (52A) |
| 14 AND 16 | 11.0% | 6 (48), 7 (54A) |
| 14, 16 AND 18 | 20.6% | 6 (50), 7 (56A) |

In the fabrication of the phased array antennas of the present invention the location of the feed point of the coaxial cable 26 (the location of second bus 36 in FIG. 5) needs to be taken into account. Since the feed points of the patches 14, 16 and 18 are separated by some distance, some of the patches 14, 16 and 18 require some connecting wire length to the coaxial cable feed point. This length of wire adds inductive impedance to the impedance of the patch 14, 16 or 18 that the wire feeds, and thus lowers the effective resonant frequency of the patch and changes the effective resistance of the patch at resonance. Therefore, the patch widths should take into account this factor. The optimal location of the feed point was found to be half-way between patch 18 and the ground-plane element 12. Placing the feed point near the ground-plane element 12 or near patch 18 favored the match near the resonance frequency of respective patches 14 or 18 at the expense of the match near the resonance frequency of respective patches 18 or 14. The reason of this unbalancing of match is most likely due to the excessive inductance of the resultant respective connecting wires 38 and 40.

In the practice of this invention, the three patches 14, 16 and 18 were found to be the most favorable. The reason is that ideally, the impedance locus of the individual patch elements should be that of a series RLC (Resistor Inductor Capacitor) circuit. The impedance with a constant resistance value starts at a high capacitive impedance, reduces to a constant resistance at resonance, and increases to a high inductive impedance with frequency. However, the patch element impedance is different to some extent; it starts at a somewhat high capacitive impedance (once past antiresonance), it does not have a constant value of resistance with frequency, and its locus is shifted toward the inductive side of the Smith Chart. It is noted that there is even more inductive shift when the elements are stacked for the multiple element antenna as in FIG. 5 and an element is fed by the lengthened feed such as wires 34, 38 and 40. FIG. 4(E) shows ideally that the resultant impedance of three combined elements should rotate about a common resistance value (usually chosen to be the feed cable impedance 50 ohms). FIG. 6, band 50, shows that the actual impedance of combining the three patch elements is spread out inductively above a resistance value of about 40 ohms. The spreading is due to the non-ideal nature of the patch element impedance locus.

Figure 8:
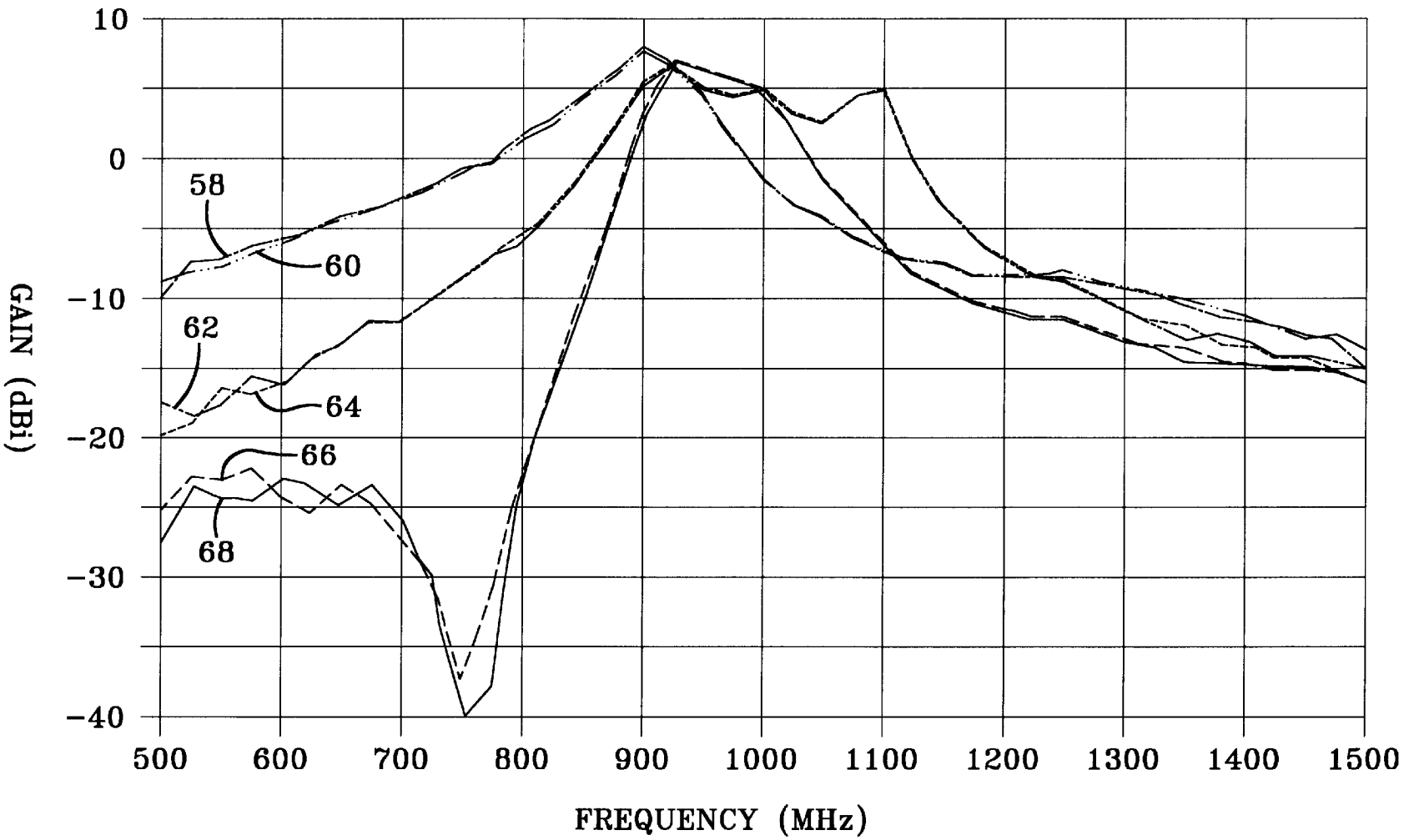
FIG. 8 illustrates the gain response of the antenna elements making up the antenna configuration of FIG. 5.
Figure 9A:
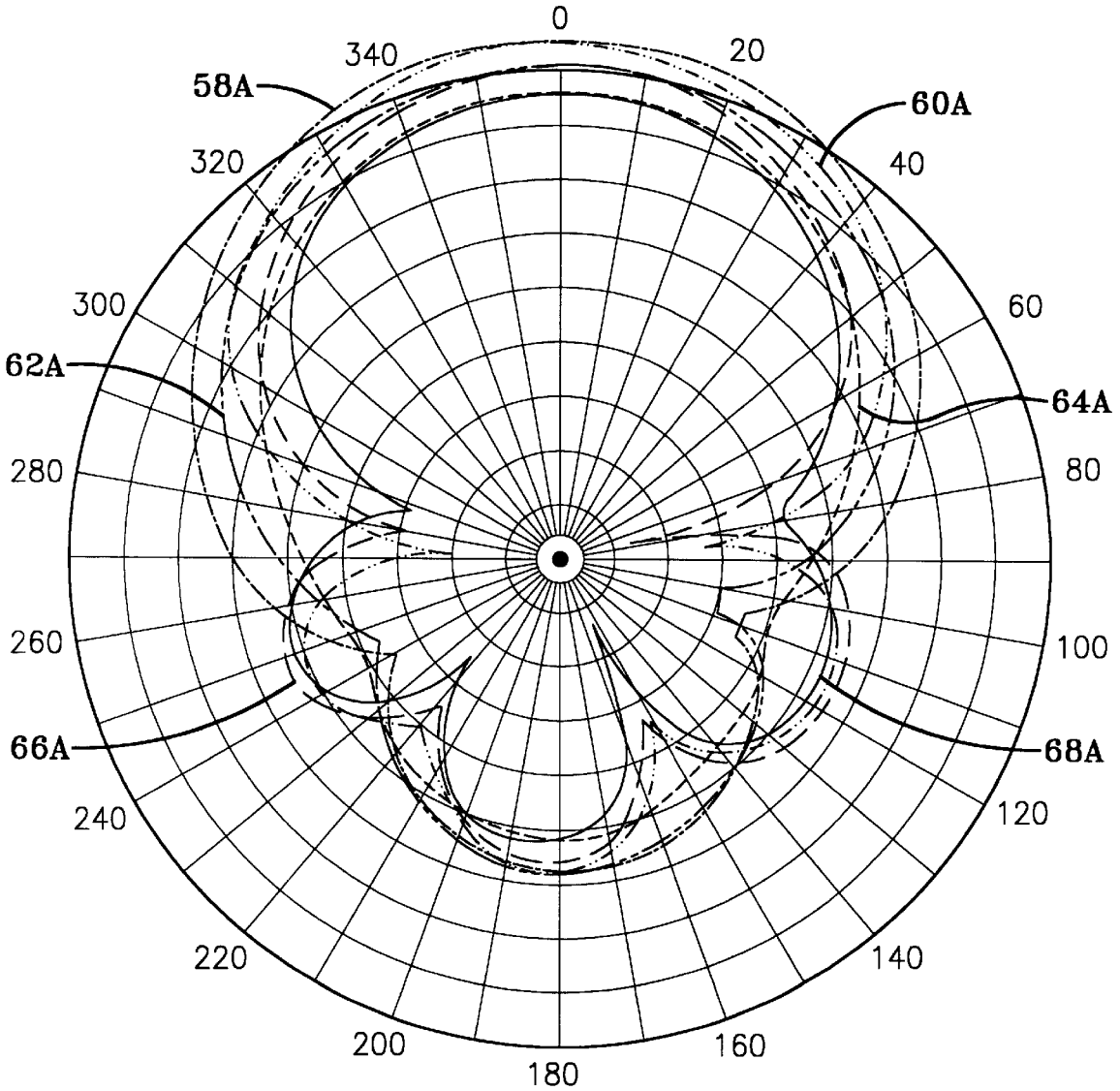
FIG. 9 is composed of FIGS. 9(A), 9(B), 9(C) and 9(D) each showing a respective radiation pattern of the antenna configuration of FIG. 5.
Figure 9B:
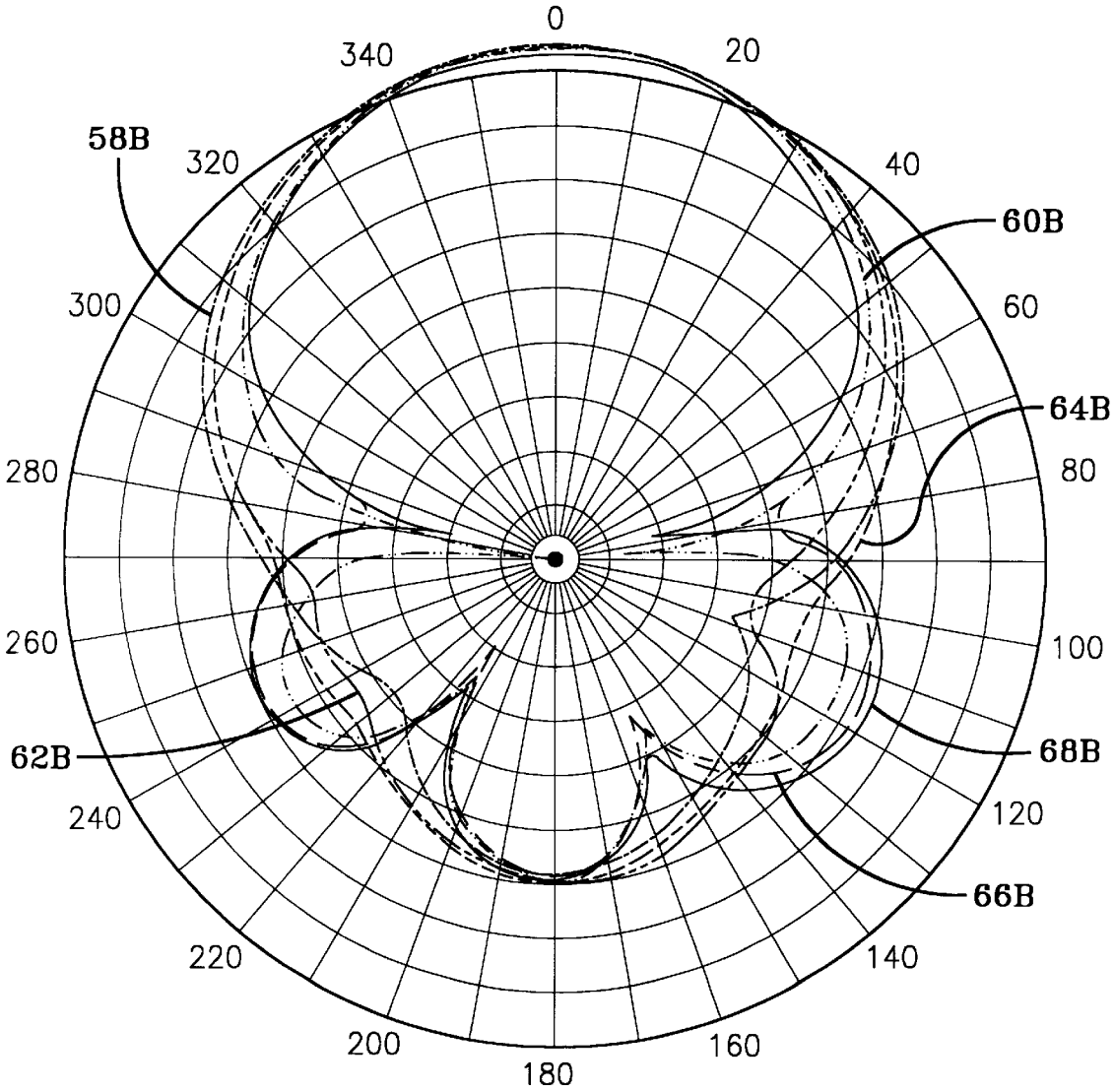
Figure 9C:
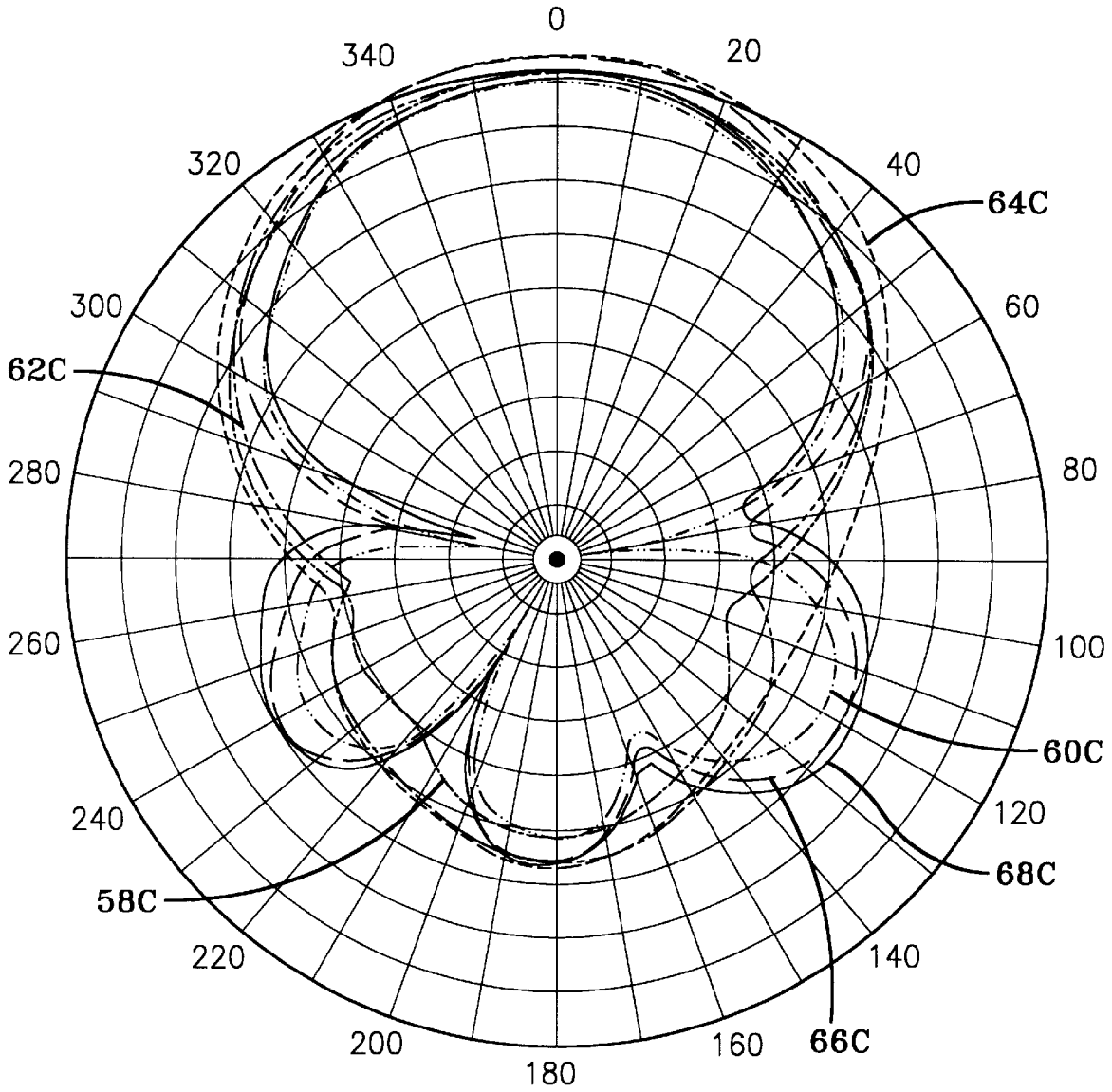
Figure 9D:
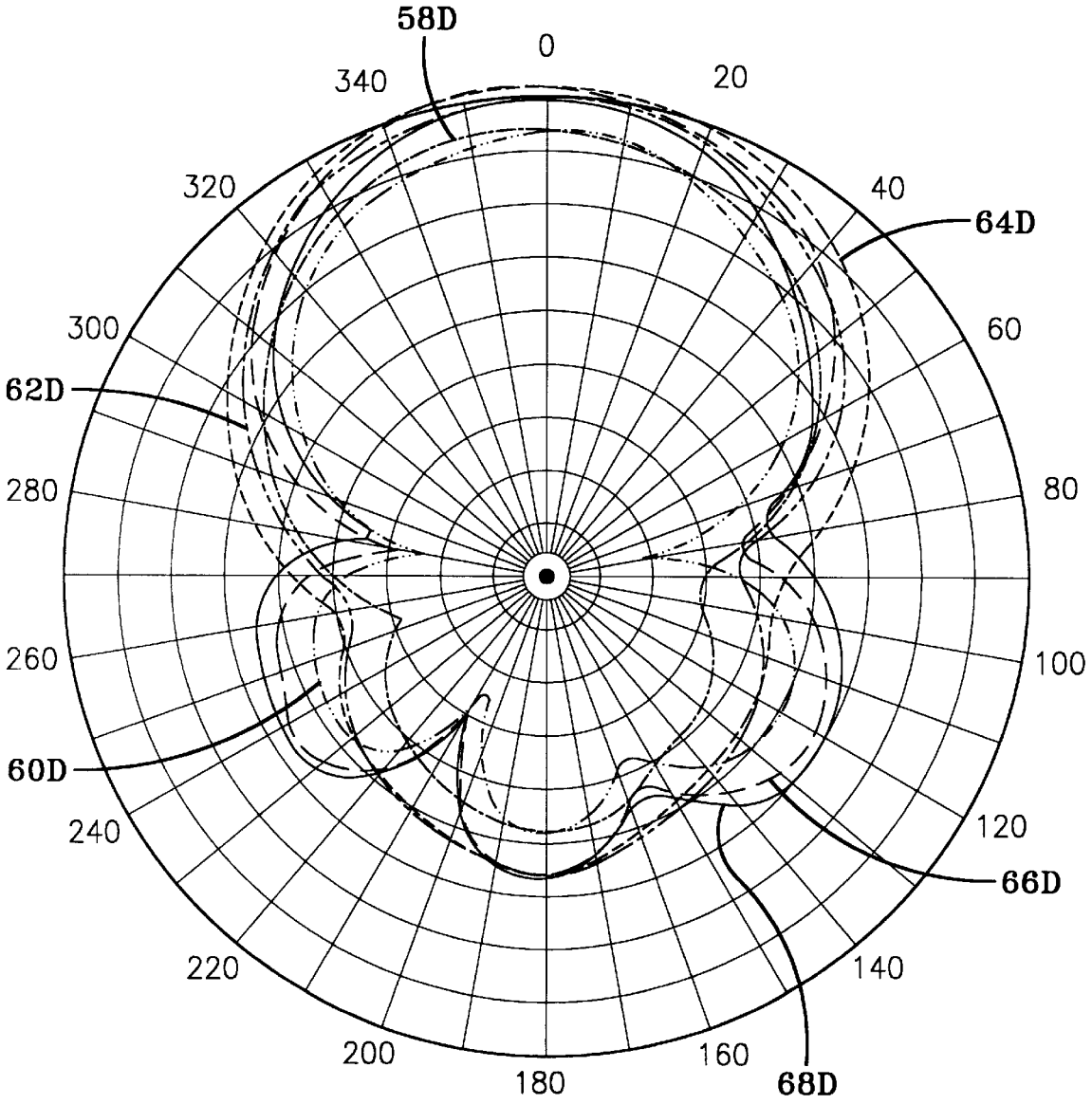

In a further practice of the present invention it was determined that a fourth element could be added if the patch element impedance locus could be corrected to some extent to the desired ideal locus. One manner is to add a series capacitance to the feed point of each patch element so as to cancel the inductive shift of the patch element impedance locus. Overhead gains (dBi) of the antenna with one, two and three elements, corresponding to patch 14 only, patch 14 with patch 16 and all three patches 14, 16 and 18, are shown in FIG. 8 having plots 58, 60, 62, 64, 66 and 68. The correlation between the radiation pattern of the individual antenna configurations is tabulated in Table 5 (note that the gains are approximately 3 db too high, due to a measurement calibration error).

TABLE 5

| NO. OF ELEMENTS | PATCHES | ELEVATION PATTERN | FIG. 8 SEGMENT |
|---|---|---|---|
| 1 | 14 | PLANE PERPENDICULAR TO PATCH FEED EDGE | 58 |
| 1 | 14 | PLANE PARALLEL TO PATCH FEED EDGE | 60 |
| 2 | 14, 16 | PLANE PERPENDICULAR TO PATCH FEED EDGE | 62 |
| 2 | 14, 16 | PLANE PARALLEL TO PATCH FEED EDGE | 64 |
| 3 | 14, 16, 18 | PLANE PERPENDICULAR TO PATCH FEED EDGE | 66 |
| 3 | 14, 16, 18 | PLANE PARALLEL TO PATCH FEED EDGE | 68 |

As seen in FIG. 8, the increase in bandwidth is accomplished with multiple elements, i.e., 14 and 16 and 14, 16 and 18, although there is some loss in gain in the matched band of the antenna. This loss may be the result of the normal single patch losses being magnified by the way the impedances of the multiple patches are being combined.

The patterns radiated by the antenna array of the present invention are shown in FIG. 9 composed of FIGS. 9(A), 9(B), 9(C) and 9(D) having resonant frequencies, in MHz, of 900, 925, 950 and 975, respectively. The radiation patterns of FIG. 9 are yielded by the antennas having the plots of FIG. 8 thus the patterns are labeled corresponding to plots 58–68 of FIG. 8 and identified with the suffix for the FIGS. 9(A)–9(D). FIG. 9 shows typical patterns of the antenna (dBi) with one, two and three elements, as tabulated in the previous table (note again that the gains are approximately 3 db too high, due to a measurement calibration error). Further, note there is basically no change in pattern shape in the multiple element cases.

It should now be appreciated that the present invention provides a broadband phased antenna array comprising multiple patches all direct feed and all radiating a desired pattern and at a selected bandwidth.

It should be further appreciated that the present invention is unlike the multiple element patch antenna with parasitic elements, which can have possible band patterns from a parasitic element radiating with a wrong phase. The present invention provides the multiple element patch antenna with all elements being directly fed so as to avoid bad patterns since all elements are directly fed with the correct phase.

Furthermore, the prior art multiple element patch antenna with parasitic elements is impedance wise limited to 3 elements, since the resonant/antiresonant loops formed by additional parasitic elements follows the impedance locus of the directly fed element. With the multiple element patch antenna of the present invention having all elements directly fed, more than three (3) elements can be combined to form a broadband antenna, since the resonant/antiresonant loops formed by additional elements all rotate about a common resistance, which can be Zo. An antenna with three (3) elements was the most favorable for the present invention, since the impedance locus of an individual element was not that of the ideal case of a series RLC circuit, somewhat restricting the antenna to three (3) patches. It is expected that correcting the actual locus will allow the addition of at least a fourth element to achieve the same desired results of the three element antenna.

It will be understood that various changes in the details, materials, steps and arrangement of parts, which have been herein described and illustrated in order to explain the nature of the invention, may be made by those skilled in the art within the principle and scope of the invention as expressed in the appended claims.

What is claimed is:

1. A broadband antenna comprising:

a ground-plane element with predetermined length and width dimensions and having an aperture therein at a predetermined location near its center;

a plurality of antenna elements having an uppermost antenna element;

a plurality of dielectric layers respectively interposed between and separating said plurality of antenna elements into a stacked arrangement having alternating odd and even numbered antenna elements, and further separating said stacked arrangement from said ground-plane element, said stacked arrangement having an odd numbered element nearest said ground-plane element;

an RF feed line having an outer conductor and a center conductor, the feed line protruding through said aperture of said ground-plane element, said RF feed line extending upward to a feed point that is about half the distance between said ground-plane element and said uppermost antenna element; and a feed arrangement having said outer conductor comprising a first bus and said center conductor comprising a second bus, said first bus being connected to said ground-plane element and to every even numbered antenna element and said second bus being connected to every odd numbered antenna element.

2. The broadband antenna of claim 1 wherein said ground-plane element and said plurality of antenna elements are comprised of copper.

3. The broadband antenna of claim 1 wherein said ground-plane element and said plurality of antenna elements each have a thickness of about 3 mils.

4. The broadband antenna of claim 1 wherein a plurality of dielectric layers each has a thickness of about 0.25 inches.

5. The broadband antenna of claim 1 wherein said ground-plane element has predetermined length and width dimensions of about 12 inches and about 12 inches respectively.

6. The broadband antenna of claim 1 wherein said antenna elements have edges and a centerline and said connections of said first and second busses are at the centerline of the edges of the antenna elements nearest said feed point.

7. A broadband antenna comprising:

a ground-plane element with predetermined length and width dimensions and having an aperture therein at a predetermined location near its center and comprised of an electrically conductive sheet having a first predetermined thickness;

a first dielectric layer having lesser length and width dimensions than said ground-plane and stacked thereon and having a second predetermined thickness;

a first antenna element having at least the same length and width dimensions as said first dielectric layer and stacked thereon and comprised of an electrically conductive sheet having a third predetermined thickness;

a second dielectric layer having lesser length and width dimensions than said first antenna element and stacked thereon and having a fourth predetermined thickness a second antenna element having at least the same length and width dimensions as said second dielectric layer and stacked thereon and having a fifth predetermined thickness;

a third dielectric layer having lesser length and width dimensions than said second antenna element and stacked thereon and having a sixth predetermined thickness;

a third antenna element having at least the same length and width dimensions as said third dielectric layer and stacked thereon and having a seventh predetermined thickness; and an RF feed line having an outer conductor and a center conductor, the feed line protruding through said aperture of said ground-plane element, said RF feed line extending upward from said feed point to a location of about half the distance between said ground-plane element and said third antenna element, said outer conductor having means for being electrically connected to said ground-plane element and to said second antenna element, said center conductor having means for being electrically connected to both said first and third antenna elements.

8. The broadband antenna of claim 7 wherein said first, second and third antenna elements have edges and a centerline and said means for electrically connecting to said first, second and third antenna elements are at the centerline of the edges of the first, second and third antenna elements nearest said feed point.

9. The broadband antenna of claim 7 wherein said electrically conductive sheets of said ground-plane element and said first, second and third elements are comprised of copper.

10. The broadband antenna of claim 7 wherein said first, third, fifth and seventh predetermined thicknesses are each 3 mils.

11. The broadband antenna of claim 7 wherein said second, fourth and sixth predetermined thicknesses are each 0.25 inches.

12. The broadband antenna of claim 7 wherein said ground-plane has predetermined length and width dimensions of about 12 inches and about 12 inches respectively.

13. The broadband antenna of claim 7 wherein said first antenna element has length and width dimensions of about 5.906 inches and about 5.906 inches respectively.

14. The broadband antenna of claim 7 wherein said second antenna element has length and width dimensions of about 5.5 inches and about 5.5 inches respectively.

15. The broadband antenna of claim 7 wherein said third antenna element has length and width dimensions of about 4.9 inches and about 4.9 inches respectively.

16. A method of providing a directly fed broadband antenna for a band of interest, the antenna having a ground-plane element, an aperture in a central region of the ground-plane element, a plurality of antenna elements each having dimensions that are selectable so that each antenna element resonates a selected resonant frequency, a plurality of dielectric layers and a feed line having an outer conductor and a center conductor, said outer conductor being directly connected to one of said plurality of antenna elements and said center conductor being directly connected to another one of said plurality of antenna elements and with all of said plurality of antenna elements being directly connected to one of said outer and center conductors, said plurality of antenna elements having lowermost and uppermost antenna elements and said plurality of dielectric layers respectively interposed between and separating said plurality of antenna elements into a stacked arrangement and further separating said stacked arrangement from the ground-plane element, the lowermost element of the stacked arrangement being nearest the ground-plane element, the uppermost element of the stacked arrangement being farthest from the ground-plane element, said method comprising the steps of:

selecting the dimensions of said lowermost antenna element so that its resonant frequency is at the bottom of said band of interest;

selecting the dimensions of a next antenna element nearest the ground-plane element so that its resonant frequency is greater than that of the lowermost antenna element but overlapping that of the lowermost antenna element and within a VSWR of less than 1.5; and iteratively selecting the dimensions of succeeding next antenna element nearest the ground-plane element so that its resonant frequency is greater than but overlapping that of the next antenna element nearest to the ground-plane element and within a VSWR of less than 1.5 until the band of interest has been covered.

17. The method of claim 16 wherein said plurality of antenna elements and said plurality of dielectric layers are selected to be of a number of at least three.

18. The method of claim 17 wherein said resonant frequencies of said antenna elements are selected so as to overlap within a VSWR of less than 4.0.

19. The method of claim 16 further comprising the step of arranging said feed line to be about half-way between said ground-plane element and said uppermost antenna element.

* * * * *